US006223017B1

(12) United States Patent
Akutsu et al.

(10) Patent No.: US 6,223,017 B1
(45) Date of Patent: Apr. 24, 2001

(54) LAMINATE FIXING ROLLER, APPARATUS USING SAME AND METHOD FOR MANUFACTURING LAMINATE FIXING ROLLER

(75) Inventors: Eiichi Akutsu; Hiroh Soga; Shigehito Ando, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 08/125,189

(22) Filed: Sep. 23, 1993

(30) Foreign Application Priority Data

Oct. 2, 1992 (JP) ..... 4-287135

(51) Int. Cl.[7] ..... G03G 15/20; B21B 27/06; H05B 3/02

(52) U.S. Cl. ..... 399/330; 219/216; 219/469; 399/335

(58) Field of Search ..... 355/285, 289, 355/290; 219/216, 469, 470; 399/328, 330, 335

(56) References Cited

U.S. PATENT DOCUMENTS

| | | | | |
|---|---|---|---|---|
| 4,395,109 | * | 7/1983 | Nakajima et al. | 355/289 X |
| 4,438,321 | * | 3/1984 | Moraw | 219/216 |
| 4,628,183 | * | 12/1986 | Satomura | 219/216 |
| 4,724,303 | * | 2/1988 | Martin et al. | 219/216 |
| 4,813,372 | * | 3/1989 | Kogure et al. | 219/216 X |
| 4,883,941 | * | 11/1989 | Martin et al. | 219/216 |
| 5,065,193 | * | 11/1991 | Saitoh et al. | 355/290 |
| 5,087,946 | * | 2/1992 | Dalal et al. | 355/285 |
| 5,182,606 | * | 1/1993 | Yamamoto et al. | 355/289 |

FOREIGN PATENT DOCUMENTS

| | | |
|---|---|---|
| 42-14119 | 8/1942 | (JP) . |
| 56-7236 | 2/1981 | (JP) . |
| 58-36337 | 8/1983 | (JP) . |
| 59-21557 | 5/1984 | (JP) . |
| 4-114184 | 4/1992 | (JP) . |

OTHER PUBLICATIONS

"Soft Roll Fuser for Color Copiers" (IS&T's Eight International Congress on Advances in Non–Impact Printing Technologies) Japan, 1992.

"New 'Surf' Fixing System" (IS&T's Sixth International Congress on Advances in Non–Impact Printing Technologies) Japan, 1990.

"Teichaku sisutemu ni okeru shouene gijyutsu" (Energy–Saving Technology in The Fixing System Japan, 1992.

* cited by examiner

*Primary Examiner*—Fred L Braun
(74) *Attorney, Agent, or Firm*—Oliff & Berridge, PLC

(57) ABSTRACT

A localized heating device includes a laminate structure of a heat insulating substrate, a heating region made by sandwiching a heating layer between a pattern electrode layer and a conductive layer and a low surface energy layer. In another aspect of the invention, a localized heating apparatus includes a localized heating device and a power supply system that supplies a current selectively and stably to the heating layer between the pattern electrode layer and the conductive layer from the current supply portion formed at one or both end portions of the heating region.

31 Claims, 4 Drawing Sheets

LAMINATE FIXING ROLLER, APPARATUS USING SAME AND METHOD FOR MANUFACTURING LAMINATE FIXING ROLLER

FIELD OF THE INVENTION

The present invention relates to a localized heating device for thermal fixing, which is employed in an image-fixing device used in a copying machine, a printer, a facsimile machine or the like and a localized heating apparatus using same.

BACKGROUND OF THE INVENTION

Conventionally, as described in Japanese examined patent publications Sho 59-21557 (1984), Sho 58-36337 (1983), Sho 56-7236 (1981) and so forth, a thermal fixing device comprising a metal roller which is in the form of a pipe and having a coating of fluorine-based resin or silicon rubber on its surface and a heater lamp which is in the form of a bar approximately in the center of the hollow portion inside the metal roller, which form a heating roller, is well known as a general fixing device. If a current is supplied to the heater lamp, radiative heat from the heater lamp is absorbed by the internal wall of the metal roller, which heats the entire heating roller to the temperature required for fixing, and if a recording medium having an unfixed toner image is passed between the heating roller and a pressure roller which contacts the heating roller under pressure, the toner image is fixed by heat and pressure.

Such a thermal fixing device, however, has problems in power consumption for heating the entire metal heating roller to the temperature required for fixing and maintaining the temperature, the temperature rise inside the device because of the large amount of heat produced, the impossibility of heating the roller to the temperature required for fixing in a short time because of high amount of heat capacity of the heating roller and the difficulty of controlling the temperature of toner materials accurately when fixing, which leads to problems such as a decline in image quality.

As described in Japanese unexamined patent publication Hei 4-114184 (1992), the present inventors proposed an image-fixing device comprising a heating means which heats an unfixed image by contacting an image holding member having the unfixed image thereon under pressure according to the image information, a power supply means having contact electrode portions disposed in the direction along the width of the image holding member and supplying electrical energy to the heating means, a pressing means which is disposed facing the heating means across the image holding member having an unfixed image and presses the image holding member upwards, in which the heating means comprises an adhesion prevention layer preventing adhesion of the colored imaging material forming the unfixed image, a conductive layer which is laminated on the adhesion prevention layer and a heating layer which is laminated on the conductive layer and generates heat by being supplied electrical energy from the conductive layer. This image-fixing device made effects in reduction of energy consumption, realization of quick start of an apparatus, speeding up of fixing, reduction of temperature rise inside the apparatus or the like.

In the image-fixing device according to the above described proposal, however, image drive signals to fix an unfixed image are input to the heating means by means of a recording head which comprises a plurality of blocks disposed along the longituding direction of the heating means, and the recording head is supported to contact the heating means directly and frictionally. The heating means is heated selectively by the recording head by block thereof according to the image signals. With this device, if there is an insufficient friction with the recording head, stable heating in all the blocks of the heating means, which are disposed along the longituding direction of the heating means, may not be produced. Further, as the heating device is thin, the transporting quality of the image holding member is also liable to be reduced.

Studies have been carried out to develop the fixing device of the present invention, in which the problems of the conventional thermal fixing device, such as high power consumption, a tendency to temperature rise inside the device because of the large amount of generated heat and leakage thereof, a long preparation time for reaching the required temperature because of high heat capacity of the heating roller, and the difficulty of controlling the temperature accurately when fixing, which reduces the image quality, are solved more easily.

SUMMARY OF THE INVENTION

It is an object of the present invention to provide a localized heating device free of the defects found in the conventional art.

It is another object of the present invention to provide a localized heating device which is simple, reduces power consumption and with fewer problems of the temperature rise inside the device when installed in various devices.

It is a further object of the present invention to provide a localized heating device which requires a shorter preparation time to reach the specified temperature, whose temperature is capable of being controlled easily and which is used for thermal fixing in various image-fixing devices.

It is a yet further object of the present invention to provide a localized heating apparatus comprising such a localized heating device and used as a practical image-fixing device in a copying machine, a printer, a facsimile machine or the like.

Additional objects and advantages of the invention will be set forth in part in the description which follows and in part will be apparent to a person with ordinary skill in the art from the description, or may be learned by practice of the invention.

The present invention relates to a localized heating device comprising a laminate structure of a heat insulating substrate, a heating region made by sandwiching a heating layer between a pattern electrode layer and a conductive layer and laminating same on the heat insulating substrate and a low surface energy layer laminated thereon.

The present invention also relates to a localized heating apparatus comprising such a localized heating device and a power supply system which supplies a current selectively and stably to the heating layer between the pattern electrode layer and the conductive layer from a current supply portion formed at one or both end portions of the heating region.

BRIEF DESCRIPTION OF THE DRAWINGS

The manner by which the above objects and the other objects, features and advantages of the present invention are attained will be fully evident from the following detailed description when it is considered in light of the accompanying drawings, wherein.

DETAILED DESCRIPTION OF THE INVENTION

Figure 1:
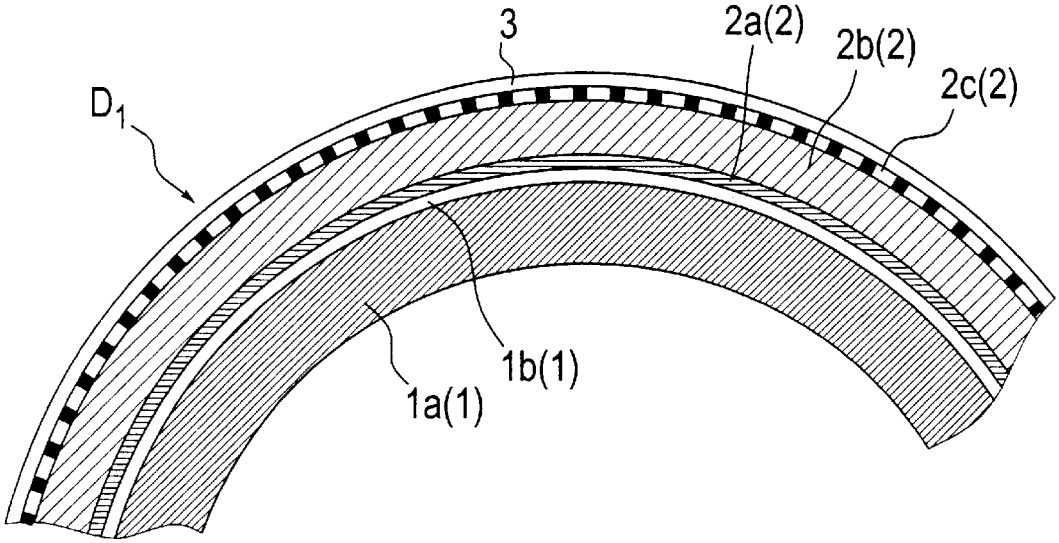
FIG. 1 is a partial cross-sectional view of embodiment 1 of the localized heating device in the form of a rigid roller according to the present invention.

The heat insulating substrate of the present invention is heated as it supports the heating region and the low surface energy layer, and when the localized heating apparatus comprising the localized heating device is used as an image-fixing device, it transports the heated member, namely an image holding member such as a recording medium. For the material of this substrate, it is desirable to use metal materials such as aluminum, nickel or special use stainless steel, plastic materials such as polyimide resin, silicon resin or aromatic polyamide resin, or ceramic materials such as alumina, silicon oxide or zirconia, which have at least sufficient heat resistance to withstand the temperature required for fixing the unfixed toner image and are excellent in processing quality and economy. They must be formed in the form of, for example a flexible endless belt, a rigid roller or a cylinder.

As heat insulation is required only between the heat insulating substrate and the heating region laminated thereon, the entire substrate may be made of heat insulating materials such as plastic material or ceramic material, or the substrate may be formed by laminating a layer of low thermal conductivity, which is excellent in heat resistance, on the surface of a heat conductive material such as a metal material or a material having relatively poor heat resistance such as a plastic material.

For the material used to form a layer of low thermal conductivity, a material having a thermal diffusion coefficient of not more than $10^2$ $mm^2/s$, preferably not more than $10^0$ $mm^2/s$ is desirable; to reduce the amount of leakage of thermal energy produced in the heating layer to the base layer and improve the energy efficiency in the heating layer, and it is desirable that the volume resistivity thereof is at least $10^5$ Ω·cm, preferably at least $10^8$ Ω·cm in order to reduce electrical leakage in the pattern electrode layer or the conductive layer. As specific examples of such a layer of low thermal conductivity, may be set forth ceramics such as silicon oxide and compounds thereof or magnesium oxide and compounds thereof, polymers such as polyimide resin and modified compounds thereof, aromatic polyamide resin and modified compounds thereof or silicon resin and modified compounds thereof, or materials mainly comprising ceramics, or polymers.

In the present invention, a heating region made by sandwiching a heating layer between a pattern electrode layer and a conductive layer is laminated on the heat insulating substrate.

These layers may be laminated on the heat insulating substrate in this order: the pattern electrode layer, heating layer then conductive layer, or in this order: the conductive layer, heating layer then pattern electrode layer.

The pattern electrode layer forming the heating region functions as an selective input electrode layer which distributes the input current supplied to the heating layer, such that it generates heat selectively in required positions of the heating layer, and the pattern electrode layer is in a form convenient for selection, for example, a strip shape similar to the heating pattern, a linear shape or a combination thereof, or it may be in any of various separated sub-electrode forms. The separate sub-electrodes permit selective generation of heat in limited circumferential positions on the heating layer. The selective generation of heat is achieved according to the particular shape of the sub-electrodes defining the heating area on the heating layer. Electric current flows in an area corresponding to the shape of the sub-electrode from the sub-electrode surfaces which contact the heating layer to corresponding areas of the conductive layer. The cross-section of the current path through the heating layer is in the shape of the sub-electrodes. At least one side of the heating region the pattern electrode layer is exposed, and forms a part of the current supply portions to supply input current selectively to portions of the pattern electrode layer.

Any kind of film, for example a sputtered film or a vacuum vapor deposited film of a metal and a conductive ceramic or a screen printed film of conductive paste, may be used to form such a pattern electrode layer as long as it is excellent in conduction, and is formed in the specified pattern by photolithographic, screen printing or other processes. Generally, the thickness of the pattern electrode layer is not more than 5 μm, and preferably not more than 1 μm. If the thickness exceeds 5 μm, the amount of leakage of generated heat from the electrode layer increases, and the heating temperature for the input current in the heating layer is reduced.

The conductive layer forming the heating region functions as a return electrode layer for the current which is generated in the heating layer by the current supplied from the pattern electrode layer, and like the pattern electrode layer, the conductive layer is generally made of a material which is excellent in conduction and is in the form of a thin film. At least one side of the heating region the conductive layer is exposed, and it forms a part of the current supply portions for the return path of the current supplied from the pattern electrode layer.

Thin films such as a sputtered film or a vacuum vapor deposited film of a metal and a conductive ceramic or a screen printed film of a conductive paste are preferably used for the conductive layer, and the thickness of the film is generally not more than 10 μm, and preferably not more than 0.5 μm. If the thickness exceeds 10 μm, the amount of leakage of generated heat from the electrode layer increases, which reduces the heating temperature for the input current of the heating layer.

The heating layer forming the heating region is disposed between the pattern electrode layer and the conductive layer, it generates Joule heat selectively in the positions where the current is input by selection, and it has a heat resistance of at least 473.15 K, preferably at least 573.15 K, and a volume resistivity of $10^{-3}$ to $10^7$ Ω·cm, preferably $10^{-1}$ to $10^1$ Ω·cm.

Generally, to form the heating layer, at least one material from each of the groups: conductive materials such as conductive ceramic materials, conductive carbon materials and metal materials; and insulating materials such as insulating ceramic materials and heat resistant resins, are mixed or combined.

As specific examples of the conductive materials may be set forth carbon, nickel, gold, silver, iron, aluminum, titanium, palladium, tantalum, copper, cobalt, chromium, platinum, molybdenum, ruthenium, rhodium, tungsten or indium; and compounds such as vanadium dioxide, ruthenium oxide, tantalum nitride, silicon carbide, zirconium dioxide, indium oxide, tantalum nitride, zirconium nitride, niobium nitride, vanadium nitride, titanium diboron, zirconium diboron, hafnium diboron, tantalum diboron, molybdenum diboron, chromium diboron, boron carbide, molybdenum boron, zirconium carbide, vanadium carbide and titanium carbide. As a heat resistant resin, may be set forth polyimide resin, aromatic polyamide resin, polysulfone resin, polyimide amide resin, polyester-imide resin, polyphenylene oxide resin, poly-p-xylylene resin, polybenzimidazole resin, and resins or modified resins made of the derivatives thereof. Further, as an insulating material used for reducing the resistance value or binding, may be used ceramic materials such as aluminum nitride, silicon nitride, aluminum trioxide, magnesium oxide, vanadium dioxide, silicon oxide, zirconium dioxide, molybdenum dioxide, bismuth trioxide, titanium dioxide, molybdenum dioxide, tungsten dioxide, niobium dioxide and rhenium trioxide and the above described heat resistant resins.

As a material used for the heating layer, may be set forth polyimide resin having carbon dispersed therein, silicon resin having nitride powder dispersed therein, mixed ceramic material of tantalum-silicon oxide, ruthenium oxide-silicon oxide, and the thickness of this heating layer is generally not more than 20 $\mu$m, and preferably 1 to 5 $\mu$m. If the thickness of the layer exceeds 20 $\mu$m, heating efficiency for the input power is reduced, which leads to energy consumption.

Further, the localized heating device of the present invention comprises a laminate formed in this order: a heat insulating substrate, a heating region and a low surface energy layer.

This low surface energy layer prevents the toner forming the unfixed toner image from being attached to the heating portion when the localized heating device is used as an image fixing device of the unfixed toner image, and it also protects the heating region from physical damage. Thus, as a material forming the low surface energy layer, the one having a critical surface tension of not more than $32\times10^{-5}$ N/cm, preferably not more than $22\times10^{-5}$ N/cm is desired. If the critical surface tension exceeds $32\times10^{-5}$ N, a part of the toner forming the unfixed toner image is attached to the heating portion, which pollutes the surface of the heating device.

As a material forming such a low surface energy layer, may be used fluorine-based resin, fluoro type rubber, dimethylsiloxane type resin, silicon rubber or the like, and composite materials made by mixing conductive powder with these materials are also used to reduce the electrical resistance of the layer.

Further, to improve the effect of toner offset prevention, an anti-adhesion agent such as silicon oil or a lubricant may be applied. Generally, the thickness of this low surface energy layer is not more than 10 $\mu$m, preferably 3 to 0.2 $\mu$m. If the thickness exceeds 10 $\mu$m, the distance between the heating layer and the heated object is increased and heat-conveying loss increases, which reduces energy efficiency.

Thus structured localized heating device is employed in the localized heating apparatus such as an image-fixing device which carries out fixing by heat or combination of heat and pressure together with a power supply system which supplies power selectively to the heating layer disposed between the pattern electrode layer and the conductive layer from the current supply portion formed at one or both end portions of the heating region.

Here, the current supply portions are formed, as described above, by the exposed portions of the pattern electrode layer and the conductive layer, formed at one or both end portions of the heating region, and the power supply system comprises, to supply power selectively to where heating is required, for example a dynamic contact in the form of a roller or a static contact in the form of a tongue, formed on the exposed portion of the pattern electrode layer, and a dynamic contact or a static contact in the same form as above, formed on an appropriate exposed portion, preferably on the portion corresponding to the above described contact of the conductive layer.

As an input current supplied to the conductive layer from the pattern electrode layer through the heating layer by means of the dynamic or static contact, an alternating current, an electric pulse or a modulation current thereof is used, and an electric pulse is preferably used in respect of temperature control.

With an apparatus comprising a localized heating device of the present invention, for example an image-fixing device, a current is supplied selectively to a portion of the pattern electrode layer and the corresponding portion of the heating layer generates heat selectively. When fixing an unfixed toner image held by the image holding member such as a recording medium, only the required portion, for example, if the image-fixing device carries out fixing by heat and pressure, only the portion to which a pressure is applied is heated. Here, the distance between the heating layer and the unfixed toner image held by the image holding member, which is to be fixed, is significantly close, and as the required portion is selectively heated, a small amount of heat capacity is required, and the heating portion is heated in an instant, which heats the unfixed toner image to a high temperature. Furthermore, the temperature of the heated heating layer is reduced almost to the ambient temperature in a short time.

Accordingly, such a heating system reduces the total amount of heating energy and controls the temperature rise of the entire apparatus smoothly, and if necessary, a cooling system controlling the temperature rise of the entire apparatus may be provided in a localized heating apparatus such as an image-fixing device which comprises a localized heating device according to the present invention.

If a temperature detecting device 20 which detects the temperature of the heating region and a power supply controlling system 30 which controls the power supply 40 to the heating layer in accordance with the temperature detected by the temperature detecting device 20 are provided, the amount of heat produced in the localized heating device is controlled easily. If they are applied, for example to an image-fixing device, a good fixed image is obtained.

If the contact electrode portion of the current supply portions comprises a plurality of separated sub-electrode, it is preferable to provide a block separation circuit which separates the image signals into blocks corresponding to the separated electrodes, a setting circuit such as a pulse width setting circuit or a pulse count/timing setting circuit, which determines the amount of electrical energy to be supplied to each separated electrode by detecting the image signal from the block separation circuit and the ambient temperature, and a drive circuit which generates electricity for heating in accordance with the output signal from the setting circuit as discussed above, the separate sub-electrodes permit selective generation of heat and limited circumferential positions on the heating layer. The selective generation of heat in the heating layer takes the shape of the separate sub-electrodes.

Any image-forming material may be used for the localized heating apparatus of the present invention, as long as it is for fixing by heat and pressure, and for example, resin type powder, sublimated material, liquid ink material or liquid emulsion developer may be set forth.

With the localized heating device of the present invention and the localized heating apparatus using same, in addition to heating only the required portion in the heating region of the localized heating device, it is possible to reduce the distance between the heating portion and for example, an unfixed toner image held by the image holding member smoothly, which reduces the loss of generated thermal energy smoothly. As a result, the amount of generated heat is reduced, which leads to reduction of power consumption.

In addition to reducing the amount of generated heat, as the heating region is formed on the heat insulating substrate and generated heat is used effectively, leakage of heat when generated is prevented smoothly, and accordingly, temperature rise inside the apparatus is reduced.

Further, as heat is generated selectively, the volume of the heating portion is small, which leads to small heat capacity, so it is possible to raise the temperature to the required degree in a short time and to reduce the time required for it. Thus, when heating the heating region of the localized heating device in advance, the temperature is allowed to be low. Further, if conditions meet, even it is not necessary to heat the heating region in advance, which economizes or omits the time for preparation.

A low surface energy layer provided on the surface of the heating region prevents the attachment of dirt of adjacent things, for example toner of the unfixed toner image, and as the heat capacity in the heating portion is small, temperature when fixing is easily controlled, which allows stable images to be produced.

EMBODIMENT

The present invention is now described referring to embodiments and comparative embodiments.

Embodiment 1

As shown in FIG. 1, a heat insulating substrate 1 was made by applying a coating of a ceramic mainly comprising silicon oxide at a rate of 2 mm as a layer of low thermal conductivity 1*b* on the base layer 1*a* of aluminum tube having a thickness of 3 mm and a diameter of 40 mm.

A pattern electrode layer 2*a* was made by depositing gold on the layer of low thermal conductivity 1*b* by a vacuum vapor deposition process at a rate of 1 $\mu$m and forming a pattern of a. plurality of strips extending in the axial direction of the device and having a pitch of 2.1 mm and a width of 2 mm by a photolithographic process. A uniform heating layer 2*b* having a thickness of 3 $\mu$m and a volume resistivity of $5\times10^4$ $\Omega\cdot$cm was formed by applying a coating of a dispersed paste made of ruthenium compound, modified silicon resin, indium complex and acryl resin on the pattern electrode layer 2*a* of a plurality of strips by a screen printing process, such that both end portions of the pattern electrode layer 2*a* formed of a plurality of strips were exposed by 20 mm, and then firing them at 673.15 K. Further, a conductive layer of gold 2 C having a thickness of 1 $\mu$m was formed by laminating gold paste on the heating layer 2*b* by a screen printing process and firing them at 633.15 K. Thus, a heating region 2 comprising a pattern electrode layer 2*a*, a heating layer 2*b* and a conductive layer 2*c* were formed on the heat insulating substrate 1.

A low surface energy layer 3 having a thickness of 3 $\mu$m was formed on the heating region 2 laminated on the heat insulating substrate 1 by laminating a chromium layer which is not shown in the figures at a rate of 1 $\mu$m by a plating process, such that both end portions of the conductive layer 2*c* were exposed by 20 mm, applying a coating of teflon fine particle dispersed solution on this chromium layer and then firing them at 573.15 K. When the critical surface tension of the low surface energy layer 3 was measured by Zisman's method, it was $16\times10^{-5}$ N/cm. Thus formed laminate is the localized heating device $D_1$ of Embodiment 1. A plurality of pattern electrodes are disposed regularly in the direction around the circumference of the heating device, such that the small and restricted area including the contact point between the heated device $D_1$ and the pressure roller is specified. Therefore, the area to be heated to a high temperature for fixing is specified by selecting the pattern electrodes.

Figure 2:
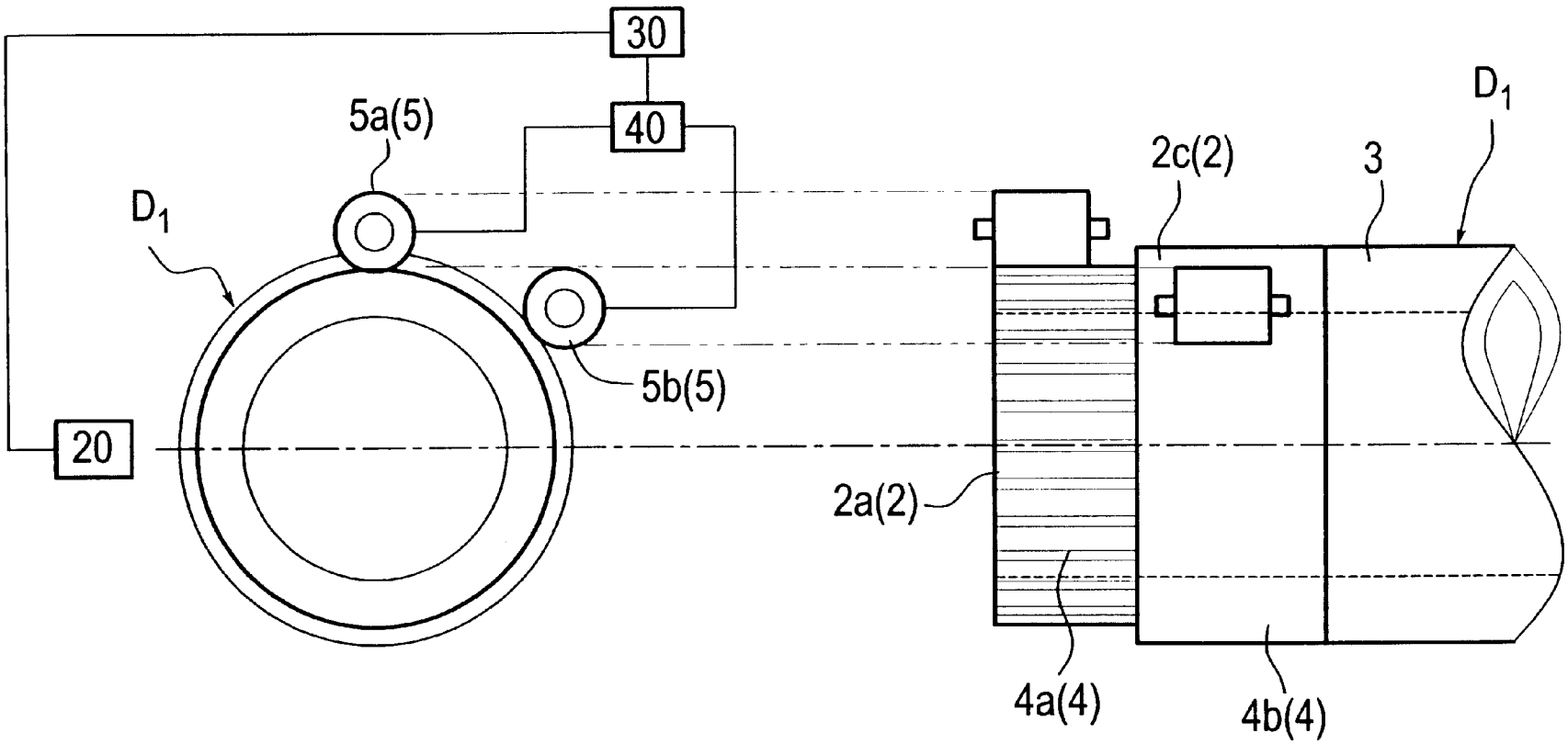
FIG. 2 illustrates the power supply system disposed at both end portions of the localized heating device of FIG. 1.
Figure 3:
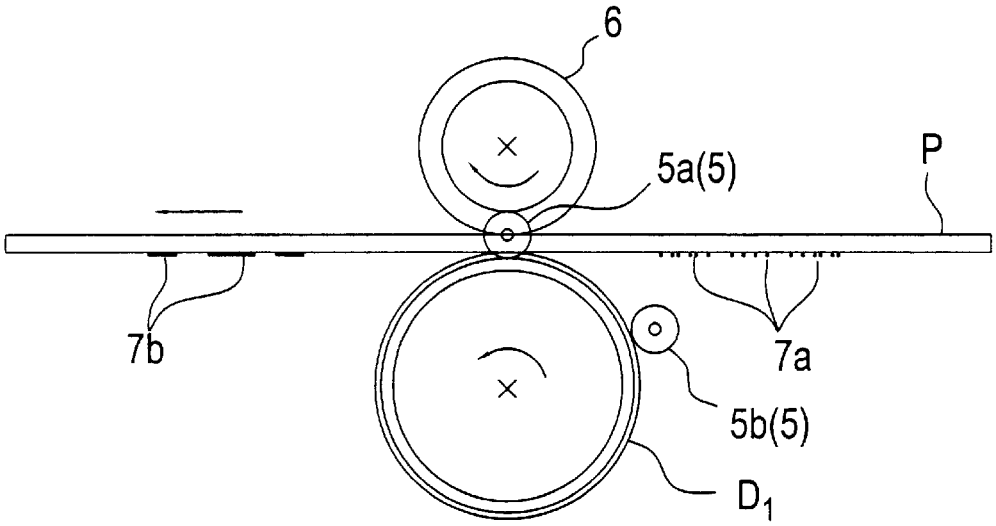
FIG. 3 illustrates an image-fixing device, wherein the localized heating device of FIG. 1 is employed.
Figure 4:
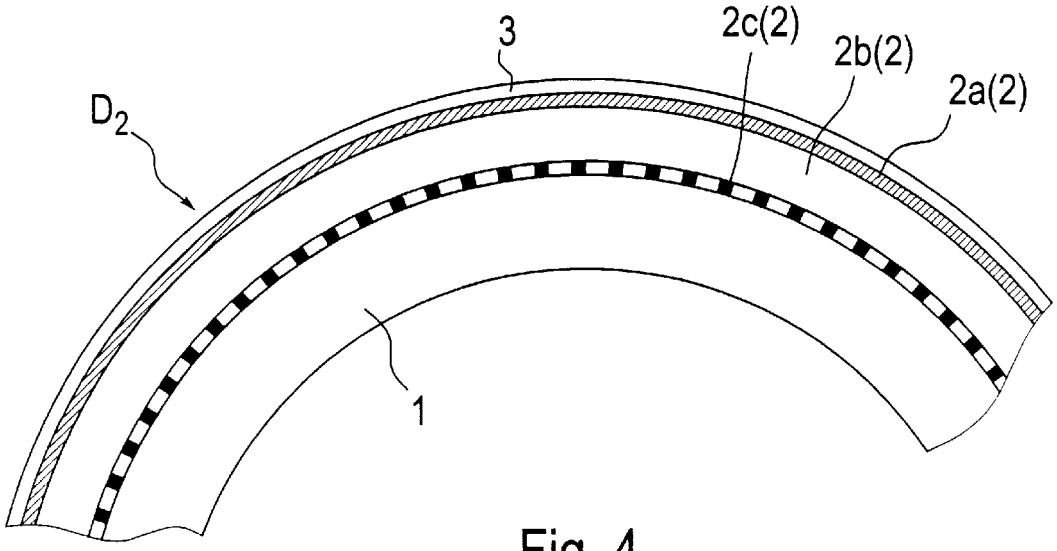
FIG. 4 is a partial cross-sectional view of the same portion as shown in FIG. 1, which illustrates embodiment 2 of the localized heating device in the form of a rigid roller according to the present invention.

Current supply portions 4 which supply a current to the heating region 2 comprise both end portions 4*a* of the pattern electrode layer 2*a* and both end portions 4*b* of the conductive layer 2*c*, which are exposed at both end portions of the localized heating device $D_1$ of Embodiment 1, and further, a power supply system 5 comprises, as shown in FIG. 2, an input current supply roller 5*a* which contacts the both end portions 4*a* and a conductive roller for return path 5*b* which contacts both end portions 4*b*. The distance in the direction around the circumference between them is 10 mm. The heating area is determined by the number of pattern electrodes on the electrode roller 5*a* and 5*b*, and to divide the heating area in detail, it is preferable that the area occupied by a pattern electrode is as small as possible.

Thus structured image-fixing device was rotated with a linear pressure between the localized heating device $D_1$ and the pressure roller 6-of 2 kg/cm and a roller linear speed of 50 mm/s. It is preferable that the contact point between the heating device $D_1$ and the pressure roller is within the heating area, and more preferably, the contact point is located downstream of the starting point of heating by a specified distance.

In the image-fixing device, electrodes having a pitch of 2.1 mm and a width of 1.2 mm and which are not shown in the figures were provided to the input current supply roller 5*a* and the conductive roller for return path 5*b*, and an electric pulse having a pulse width of 10 ms and a voltage of 12 V was applied to the heating area of the heating region 2 from these electrodes by means of the input current supply roller 5*a* and the conductive roller for return path 5*b*. As a result, the portion contacting the pressure roller 6 of the localized heating device $D_1$ was heated to 433.15 K immediately. Unfixed toner image 7*a* held by the recording medium P which passes between the localized heating device $D_1$ and the pressure roller 6 is fixed by the heat, and a stable toner image 7*b* fixed on the recording medium P was obtained.

Meanwhile, toner of the unfixed toner image 7*a* was not attached to the low surface energy layer 3, namely the surface layer of the localized heating device $D_1$, and after rubbing by an eraser for twenty times, deterioration in toner image was not found. Further, the heating region 2 of the image-fixing device was heated to the temperature high enough for fixing almost at the same time as current is supplied to this heating region 2.

Comparative Embodiment 1

The same localized heating device as embodiment 1 except for not laminating a low surface energy layer 3 was formed, and it was evaluated in the same way as embodiment 1.

The localized heating device of comparative embodiment 1, comprising an exposed chromium layer had a surface having a critical surface energy of $61\times10^{-5}$ N/cm, and after the unfixed toner image was fixed, toner of the image 7*a* was attached to the surface of the localized heating device. Further, after rubbing by an eraser for twenty times, deterioration in the fixed toner image was found.

Embodiment 2

As a heat insulating substrate 1, a roller of alumina ceramic having a diameter of 30 mm and a thickness of 2 mm was used, and a conductive layer 2*c* having a thickness of 3 $\mu$m was formed by depositing silicon oxide on its surface at a rate of 1 $\mu$m as an adhesive layer by a vacuum vapor deposition process, Applying a coating of tungsten paste on the surface of the adhesive layer by a dipping coating process and firing them by a high temperature firing process of 763.15 K. A mixed film of tantalum and silicon oxide was deposited on the conductive layer 2*c* by a double sputtering process, which formed a heating layer 2*b* having a thickness of 2 $\mu$m. Further, a pattern electrode layer 2*a* of a plurality of strips was formed by depositing molybdenum on the heating layer 2*b* at a rate of 0.3 $\mu$m by a sputtering process and etching the molybdenum layer with a pitch of 1 mm and a width of 0.9 mm.

A localized heating device $D_2$ was formed by laminating a heating region 2 comprising a conductive layer 2*c*, a heating layer 2*b* and a pattern electrode layer 2*a* on the heat insulating substrate 1, depositing silicon oxide on the heating region as an adhesive layer at a rate of 0.1 $\mu$m by a sputtering process and applying a coating of silicon type resin on the adhesive layer, which formed a low surface energy layer 3 having a thickness of 1.5 $\mu$m.

The critical surface energy of the localized heating device $D_2$ of embodiment 2, as tested in the same way as embodiment 1, was $19\times10^{-5}$ N.

As embodiment 1, a current supply portion was formed at both end portions of the heating region 2, and a power supply system comprising an input current supply roller 5*a* and a conductive roller for return path 5*b* was disposed in the current supply portions. An image-fixing device which carries out fixing by heat and pressure was made by adding a pressure roller to it.

Fixing test was carried out in the same way as embodiment 1, with a power consumption of 140 W, and after rubbing by an eraser for twenty times, a good fixed image was obtained, and the heating region of this image fixing device was heated to the temperature high enough for fixing almost at the same time as current was supplied to it.

Comparative Embodiment 2

The same localized heating device as embodiment 2 was formed except for laminating polyimide resin layer having a thickness of 2 $\mu$m instead of the low surface energy layer 2. The critical surface energy of the localized heating device of comparative embodiment 2 was $41\times10^{-5}$ N. When the same fixing test as example 2 was carried out, residual toner was attached to the polyimide resin layer, and after rubbing by an eraser for twenty times, deterioration in fixed image was found.

Embodiment 3

Figure 5:
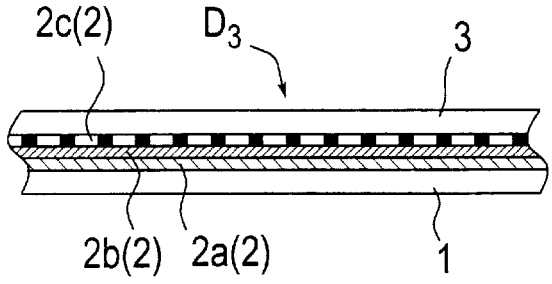
FIG. 5 is a partial cross-sectional view in the direction around the circumference showing embodiment 3 of the localized heating device in the form of an endless belt according to the present invention.
Figure 6:
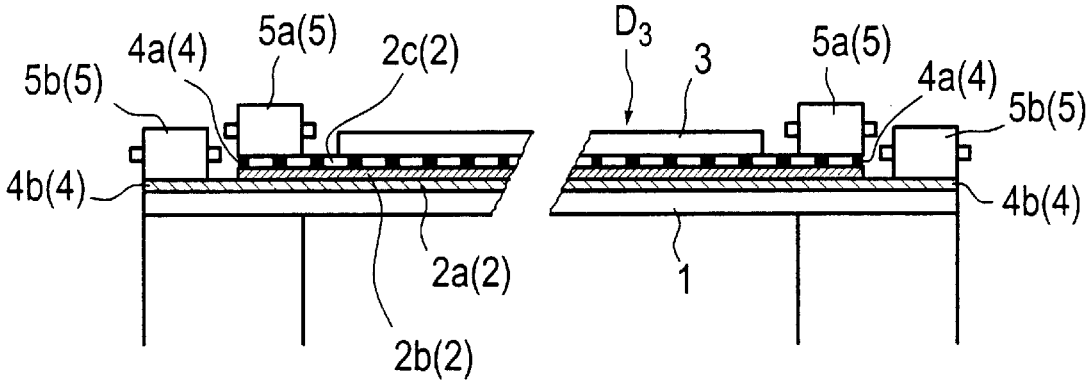
FIG. 6 is a cross-sectional view in the direction along the width of the localized heating device in the form of an endless belt of FIG. 5.

As shown in FIGS. 5 and 6, a conductive layer 2*c* of nickel was laminated at a rate of 0.5 $\mu$m by a sputtering deposition process on the heat insulating substrate 1 of polyimide in the form of a seamless belt having a thickness of 75 $\mu$m, a diameter of 100 mm and a width of 230 mm, and a heating layer 2*b* having a thickness of 2 $\mu$m and a volume resistivity of $4\times10^4$ $\Omega\cdot$cm was laminated by applying a coating of a carbon dispersed polyimide resin layer on the conductive layer 2*c* and applying thermal treatment. Further, a nickel layer having a thickness of 0.5 $\mu$m was laminated on the heating layer 2*b* by a sputtering deposition process, and a pattern electrode layer 2*a* was formed by patterning this nickel layer with a pitch of 3 mm and a width of 2.94 mm by a photolithographic process and a dry etching process Thus, a heating region 2 was formed.

A localized heating device $D_3$ in the form of an endless belt was formed by laminating a low surface energy layer 3 by applying a coating of a silicon type resin at a rate of 1.5 pm on the heating region 2. The critical surface energy of this low surface energy layer 3 was $21\times10^{-5}$ N/cm.

Figure 7:
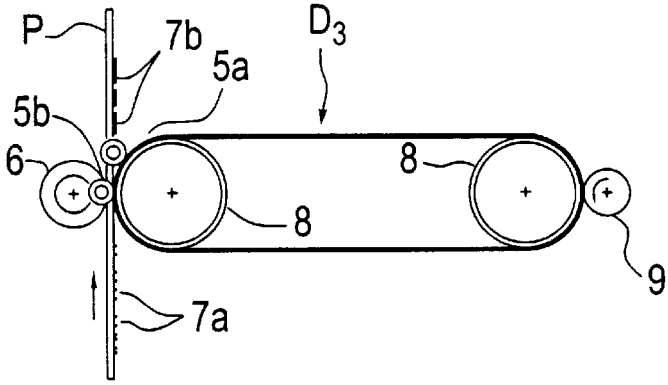
FIG. 7 illustrates an image-fixing device, wherein the localized heating device of FIG. 5 is employed.

The heating region 2 comprising a conductive layer 2*c*, a heating layer 2*b* and a pattern electrode layer 2*a* of the localized heating device $D_3$ was extended, and both end portions 4*b* of the conductive layer 2*c* and both end portions 4*a* of the pattern electrode layer 2*a*, which corresponded to the extended portions and were exposed, formed current supply portions 4, and as shown in FIG. 6, a power supply system 5 contacting these current supply portions 4 with the input current supply roller 5*a* and the conductive roller for return path 5*b* was disposed. As shown in FIG. 7, this localized heating device $D_3$ was supported by a pair of drive roller 8, and the current supply portions 4 are contacted the input current supplying roller 5*a* and the conductive roller for return path 5*b* by making the current supply portions 4 held under pressure between the drive roller 8 and the input current supply roller 5*a* and between the drive roller 8 and the conductive roller for return path 5*b* of the power supply system 5 at one drive roller 8 side. At the other drive roller 8 side, a web roller 9, from which a thin layer of silicon oil was supplied to the low surface energy layer 3 of the localized heating device $D_3$ was disposed, and thus, an image-fixing device which carries out fixing by heat and pressure by means of an endless belt was structured.

When an electric pulse having a width of 10 ms and a voltage of 15 V was applied to the heating area of the heating region 2 by means of the input current supply roller 5*a* and the conductive roller for return path 5*b*, with a roller linear pressure of the fixing portion, the portion where one drive roller 8 faces the pressure roller 6 across the localized heating device $D_3$, of 3 kg/cm, the portion contacting the pressure roller 6 of the localized heating device $D_3$ was heated to 413.15 K immediately, and an unfixed toner image 7*a* attached to the sheet P was fixed, and a stable fixed image was obtained.

Meanwhile, there was no toner attachment on the low surface energy layer 3 of the localized heating device $D_1$, and after rubbing by an eraser for twenty times, deterioration in the image was not found, and a solid image free of any defects was obtained.

What is claimed is:

1. A localized heating device, comprising a laminate structure made by laminating a heating region formed by sandwiching a heating layer directly between a pattern electrode layer and a conductive layer on a heat insulating substrate and laminating a low surface energy layer on the heating region.

2. The localized heating device described in claim 1, wherein the pattern electrode layer is fixed to the heat insulating substrate, the heating layer is fixed to the pattern electrode layer, the conductive layer is fixed to the heating layer, and the low surface energy layer is fixed to the conductive layer.

3. The localized heating device described in claim 1, wherein the conductive layer is fixed to the heat insulating substrate, the heating layer is fixed to the conductive layer, the pattern electrode layer is fixed to the heating layer and the low surface energy layer is fixed to the pattern electrode layer.

4. The localized heating device described in claim 1, wherein the heat insulating substrate is formed by laminating a layer of low thermal conductivity on the surface of a substrate.

5. The localized heating device described in claim 1, wherein the heat insulating substrate is made of a heat resistant endless belt.

6. The localized heating device described in claim 1, wherein the heat insulating substrate is made of a heat resistant rigid roller.

7. The localized heating device described in claim 1, wherein the heat insulating substrate comprises a metal.

8. The localized heating device described in claim 1, wherein the heat insulating substrate comprises one of a plastic material and a ceramic material.

9. The localized heating device described in claim 1, comprising the heat insulating substrate having a layer of low thermal conductivity, whose thermal diffusion coefficient is not more than $10^2$ $mm^2/s$.

10. The localized heating device described in claim 1, wherein at least one side of the heating region the pattern electrode layer is exposed and forms a part of current supply portions to supply input current selectively to portions of the pattern electrode layer.

11. The localized heating device described in claim 1, wherein at least one side of the heating region the conductive layer is exposed and it forms a part of current supply portions for the return path of the current supplied from the pattern electrode layer.

12. The localized heating device described in claims 1, wherein the low surface energy layer comprises a material having a critical surface tension of not more than 32 dyne/cm.

13. The localized heating device described in claim 1, wherein the low surface energy layer has a thickness between about 0.2–3 $\mu$m.

14. The localized heating device described in claim 1, wherein the pattern electrode layer has a thickness between about 1–5 $\mu$m, the heating layer has a thickness between about 1–5 $\mu$m, and the conductive layer has a thickness between about 0.5–10 $\mu$m.

15. The localized heating device described in claim 1, wherein the pattern electrode layer, the heating layer, and the conductive layer have a combined thickness of about 2.5 $\mu$m.

16. The localized heating device described in claim 1, wherein the heating layer includes a first surface and a second surface, said first surface contacting the pattern electrode layer and said second surface contacting the conductive layer.

17. The localized heating device described in claim 1, wherein the pattern electrode layer comprises separate sub-electrodes.

18. The localized heating device described in claim 1, wherein only a limited circumferential portion of said pattern electrode layer is exposed to and activated by electric current.

19. An apparatus comprising a localized heating device comprising a laminate structure is made by laminating a heating region formed by sandwiching a heating layer directly between a pattern electrode layer and a conductive layer on a heat insulating substrate and laminating a low surface energy layer on the heating region, and a power supply system which supplies current selectively from current supply portions formed at at least one end portion of the heating region to the heating layer disposed between the pattern electrode layer and the conductive layer.

20. The apparatus, comprising the localized heating device described in claim 19, wherein the input current supplied to the heating layer is one of an alternating current, a pulse current and a modulation current thereof.

21. The apparatus comprising the localized heating device described in claim 19, which has a temperature detecting device which detects the temperature of the heating region and a power supply controlling system which controls the power supply to the heating layer in accordance with the temperature detected by the temperature detecting device.

22. The apparatus described in claim 19, wherein the low surface energy layer has a thickness between about 0.2–3 $\mu$m.

23. The apparatus described in claim 19, wherein the heating region has a thickness between about 2.5–20 $\mu$m.

24. The apparatus described in claim 19, wherein the pattern electrode layer comprises separate sub-electrodes.

25. The apparatus described in claim 19, wherein said current is applied only along a limited circumferential portion of said pattern electrode layer.

26. A method of manufacturing a heat fixing roller of a fixing device, the fixing roller having a rotatable cylindrical body including a heat insulating substrate, the method comprising:

providing a heating region formed by sandwiching a heating layer directly between a conductive layer and a pattern electrode layer;

applying the heating region on the heat insulating substrate; and laminating a low surface energy layer on the heating region.

27. The method according to claim 26, wherein said applying step includes applying the pattern electrode layer to the heat insulating substrate and wherein the laminating step further includes laminating the low surface energy layer on the conductive layer.

28. The method according to claim 26, wherein said applying step includes applying the conductive layer to the heat insulating substrate and wherein the laminating step further includes laminating the low surface energy layer on the pattern electrode layer.

29. The method according to claim 26, wherein the laminating step includes depositing an adhesive layer on the heating region and applying a silicon type resin on the adhesive layer to form the low surface energy layer.

30. The method according to claim 26, further comprising the step of providing the pattern electrode layer with separate sub-electrodes.

31. The method according to claim 26, further comprising the step of supplying only a limited circumferential portion of said pattern electrode layer with electrical current.

* * * * *